US007059708B2

(12) United States Patent
Sanada

(10) Patent No.: US 7,059,708 B2
(45) Date of Patent: Jun. 13, 2006

(54) INKJET HEAD AND INKJET PRINTER USING THE SAME

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 303 days.

(21) Appl. No.: 10/785,941

(22) Filed: Feb. 26, 2004

(65) Prior Publication Data

US 2004/0201649 A1 Oct. 14, 2004

(30) Foreign Application Priority Data

Feb. 28, 2003 (JP) ..... 2003-053552

(51) Int. Cl.
*B41J 2/05* (2006.01)

(52) U.S. Cl. ..... 347/63; 347/65; 347/67; 347/56

(58) Field of Classification Search ..... 347/63, 347/65

See application file for complete search history.

(56) References Cited

U.S. PATENT DOCUMENTS 6,130,693 A * 10/2000 Ims et al. ..... 347/65
6,294,317 B1 * 9/2001 Calistri-Yeh et al. ..... 430/320
6,682,177 B1 * 1/2004 Hsu et al. ..... 347/63

FOREIGN PATENT DOCUMENTS

JP 8-132613 5/1996
JP 2001-205814 7/2001

* cited by examiner

*Primary Examiner*—Thinh Nguyen
*Assistant Examiner*—Brian J. Goldberg
(74) *Attorney, Agent, or Firm*—Whitham, Curtis, Christofferson & Cook, PC

(57) ABSTRACT

The inkjet head ejects ink droplets through ejection nozzles with pressurizing elements and includes ink channels and ink circulation paths. Each ink channel is provided in a gap between a substrate and a nozzle plate and closed at one end and permitting ink to be supplied at another end and flow toward an ink pressurizing zone where the pressurizing element and the ejection nozzle of the nozzle plate are positioned on wall surfaces in the ink channel. Each ink circulation path is provided in the ink channel such that ink pressurizing energy which has been produced by pressurizing the ink with the pressurizing element and which is traveling from the ink pressurizing zone toward downstream of ink supply flow is allowed to propagate toward more upstream of the ink supply flow than the ink pressurizing zone, whereby the ink pressurizing energy is returned toward the ink pressurizing zone. The inkjet printer mounts the inkjet head.

6 Claims, 3 Drawing Sheets

INKJET HEAD AND INKJET PRINTER USING THE SAME

BACKGROUND OF THE INVENTION

This invention relates to an inkjet head that ejects ink droplets in a continuous and consistent way. It also relates to an inkjet printer using the inkjet head.

Inkjet printers are commonly used today to record image by ejecting ink droplets onto paper and other recording media.

The inkjet head used on those inkjet printers has a plurality of ink ejection nozzles provided adjacent to each other in one direction, with a discrete ink channel being connected to each of those ink ejection nozzles such that ink is kept supplied to them. In that area of the discrete ink channel which is in the neighborhood of each ink ejection nozzle, a means of ejecting ink droplets such as a heater or a diaphragm utilizing a piezoelectric device made of PZT is formed in association with each ink ejection nozzle. By this ink ejection means, ink is locally heated and the evolving bubble is expanded or, alternatively, mechanical vibration is applied to the ink, whereupon the latter is sufficiently pressurized to eject an ink droplet through the ink ejection nozzle.

For fast recording of image and other information by the above-described inkjet head, it is desired to increase the frequency at which ink droplets are ejected. However, in order to ensure that ink droplets are ejected consistently at high frequency, it is important that the volume of the ejected ink droplet be rapidly compensated by supplying the necessary amount of ink toward the ink ejection means (this step is called ink refill). In the currently available type of inkjet head, ink refill is accomplished by restoring the meniscus on the ink through the use of its small surface tension. This approach has the problem of requiring prolonged time to restore the meniscus because, for one thing, the restoring force of the meniscus is small and, for another, the inertial resistance of ink movement is large. In addition, any vibration of the meniscus will damp only slowly, so a statically determinate meniscus cannot be restored rapidly enough by ink refilling.

With a view to solving these problems, JP 8-132613 A discloses an inkjet recording apparatus in which a common fluid compartment is pressurized in synchronism with the timing of ink refill in order to reduce its capacity, whereby ink is pressurized toward a heater as an ink ejection means by a sufficient degree to realize rapid ink refill.

The problems are also addressed in JP 2001-205814 A which discloses an inkjet head comprising a substrate having a plurality of heating resistors arranged in a straight row and a top plate spaced from the substrate and which has a plurality of ink ejection orifices, wherein ink is circulated between the substrate and the top plate in such a way that it flows in a direction perpendicular to the arrangement of the ink ejection orifices.

However, the inkjet recording apparatus disclosed in JP 8-132613 A has the problem of increased cost since a piezoelectric device that pressurizes the common fluid compartment in synchronism with the timing of ink refill and a diaphragm that is activated by the piezoelectric device to change the capacity of the common fluid compartment must at least be constructed separately. In addition, a control circuit for controlling the piezoelectric device in synchronism with the timing of ink refill must be added and it is difficult to control the piezoelectric device.

The inkjet head disclosed in JP 2001-205814 A is believed to accomplish efficient ink refill by keeping constant ink flow. However, in order to circulate the ink, a circulating pump or other suitable means is required, leading to a higher cost of inkjet printer.

SUMMARY OF THE INVENTION

The present invention has been accomplished in order to solve the aforementioned problems and has as an object providing an inkjet head that permits rapid and efficient ink refill and which yet can be manufactured at low cost.

Another object of the invention is to provide an inkjet printer using the inkjet head.

In order to attain the object described above, the present invention provides an inkjet head for ejecting ink droplets, comprising: a substrate; pressurizing elements that are provided on said substrate, each pressurizing element pressurizing ink; a nozzle plate that is spaced from said substrate and furnished with ejection nozzles, wherein said ink as pressurized by each pressurizing element is ejected as a droplet through each ejection nozzle; ink channels provided in a gap between said substrate and said nozzle plate, each ink channel being closed at one end and permitting the ink to be supplied at another end and flow toward an ink pressurizing zone where said pressurizing element and said ejection nozzle are positioned on wall surfaces in said ink channel; and ink circulation paths, each being provided in said ink channel such that ink pressurizing energy which has been produced by pressurizing said ink with said pressurizing element and which is traveling from said ink pressurizing zone toward downstream of ink supply flow is allowed to propagate toward more upstream of said ink supply flow than said ink pressurizing zone, whereby said ink pressurizing energy is returned toward said ink pressurizing zone.

It is preferable that said nozzle plate is superposed on a partition layer which is provided on said substrate to serve as part of wall surfaces of said ink channel, said ink pressurizing zone is provided near said one end of said ink channel, and said ink circulation path is formed by an island-like member that is provided near said ink pressurizing zone as part of said partition layer and which is to be surrounded with the ink.

It is further preferable that said pressurizing element pressurizes the ink by being driven on a timing determined by a specified drive frequency, and a resonance frequency at which ink pressure in said ink circulation path varies is so set that it is approximated by an integral multiple of said specified drive frequency.

In order to attain another object described above, the present invention provides an inkjet printer mounting an inkjet head according to any one of the above mentioned inkjet heads.

DESCRIPTION OF THE PREFERRED EMBODIMENTS

On the pages that follow, the inkjet head and inkjet printer of the invention are described in detail with reference to the preferred embodiments depicted in the accompanying drawings.

Figure 1A:
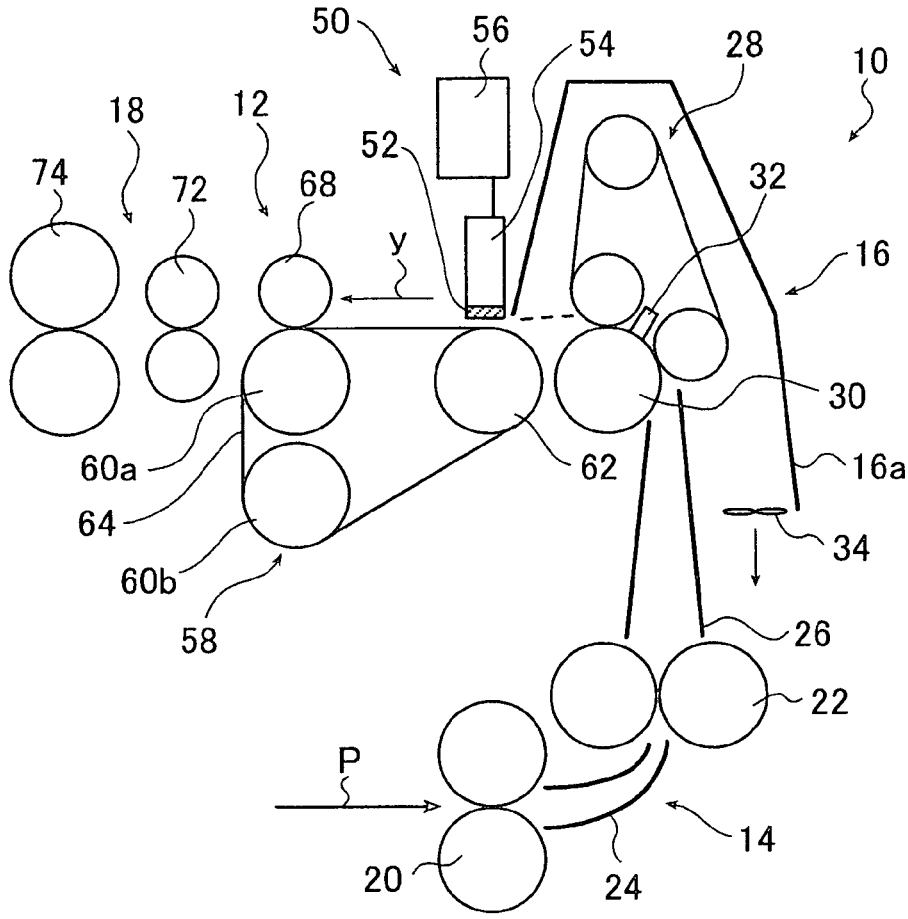
FIG. 1A shows schematically the construction of an embodiment of the inkjet printer of the invention.
Figure 1B:
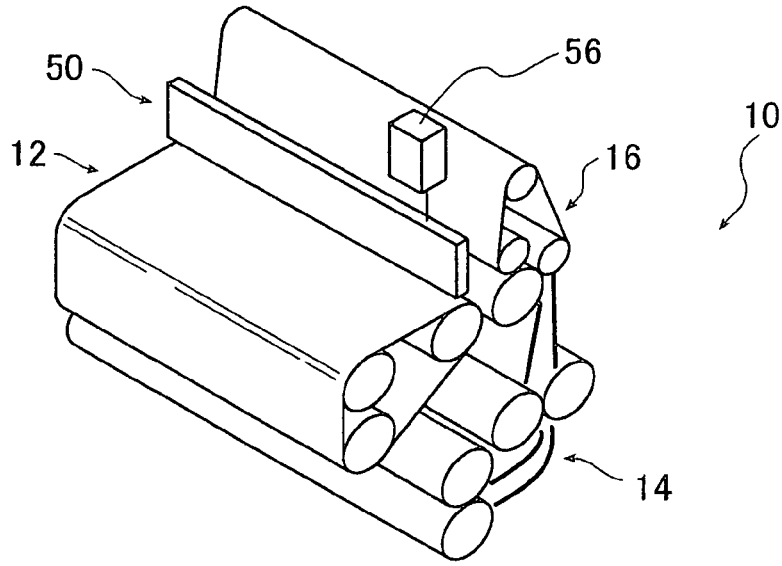
FIG. 1B is a schematic perspective view of the inkjet printer shown in FIG. 1A.

FIGS. 1A and 1B show an embodiment of the inkjet printer on which is mounted the inkjet head of the invention and which is generally indicated by 10. FIG. 1A shows schematically the construction of the printer 10 and FIG. 1B is its schematic perspective view.

The printer 10 has a recording head sub-section 50 which is a line head with a plurality of ink ejection nozzles arranged in one direction over a length greater than the length of at least one side of a recording medium P, typically a sheet of paper. The printer 10 comprises a recording section 12, a supply section 14, a preheating section 16 and a discharge section 18.

The supply section 14 has transport roller pairs 20 and 22, as well as guides 24 and 26; by means of the supply section 14, the recording medium P changes its transport path from lateral to upward direction so that it is supplied into the preheating section 16.

The preheating section 16 comprises a conveyor 28 comprising three rollers and an endless belt, a pressure roller 30 that is to be pressed against the endless belt from the outside of the conveyor 28, a heating device 32 that is to be pressed against the pressure roller 30 from within the conveyor 28, and an exhaust fan 34 that evacuates the interior of the preheating section 16.

By heating the recording medium P prior to inkjet recording, the preheating section 16 promotes the drying of the ink ejected onto the recording medium P so as to realize fast recording. The recording medium P emerging from the supply section 14 into the preheating section 16 is held between the conveyor 28 and the pressure roller 30 and has its recording side heated by the heating device 32 before it is transported into the recording section 12.

The recording section 12 comprises a recording head sub-section 50 and a recording medium transport sub-section 58; the recording head sub-section 50 comprises an inkjet head 52 having a head chip formed of a Si substrate, a recording control portion 54 and an ink tank 56, with the inkjet head 52 connected to the recording control portion 54.

The inkjet head 52 is a line head with a plurality of ink ejection nozzles for ejecting ink droplets being arranged over a length greater than the length of at least one side of the recording medium P which has the greatest width that can be handled by the printer 10 to record image. The ink ejection nozzles are arranged in a direction normal to the paper of FIG. 1A.

Thus, the recording head sub-section 50 performs recording on the medium P across the entire recording width in one action without scanning in a direction normal to the paper of FIG. 1A as the medium P is transported by the recording medium transport sub-section 58 having a drive roller 62, transport rollers 60*a* and 60*b* and a belt 64 stretched around these rollers.

The medium P bearing the record is discharged from the discharge section 18 having roller pairs 72 and 74.

Note that the inkjet head 52 in the printer 10 is by no means limited to the line head and it may be an inkjet head of a serial type which scans in a direction perpendicular to the direction of transport of the recording medium P.

Figure 2:
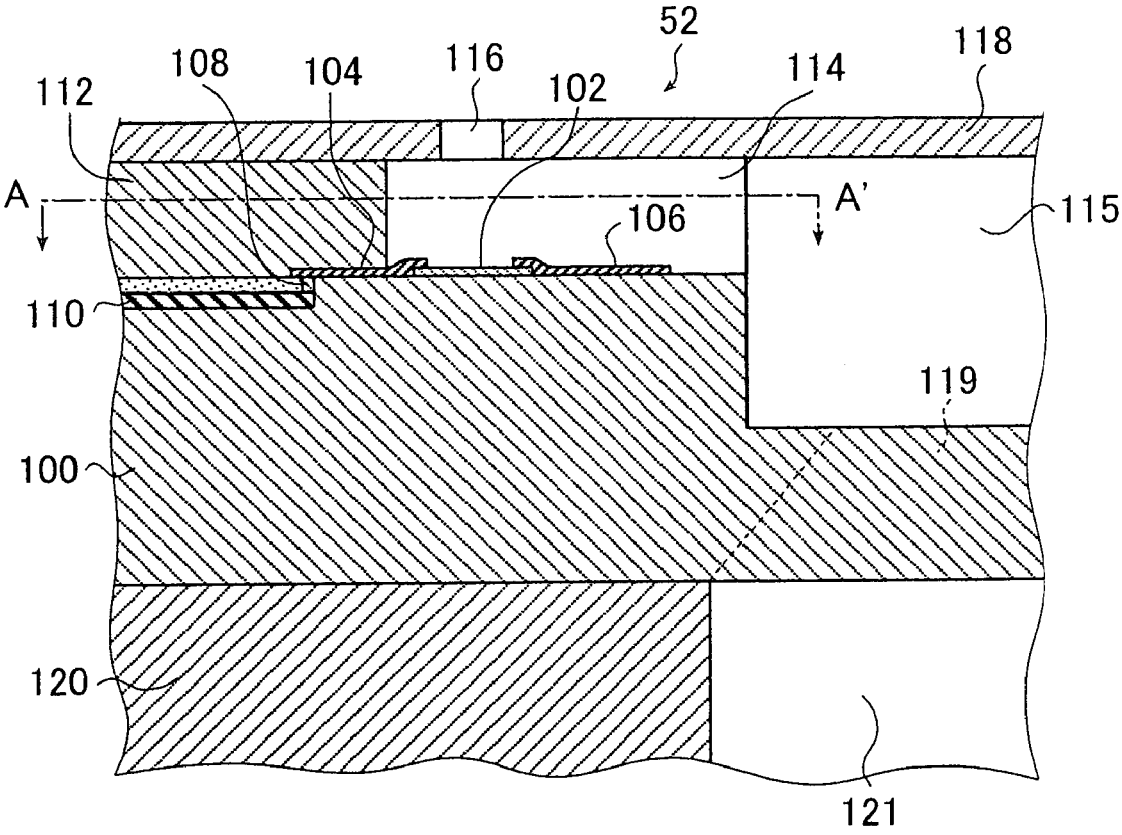
FIG. 2 shows schematically in section an embodiment of the inkjet head of the invention.

The above-described inkjet head 52 in the printer 10 has a head chip that is configured to correspond to the respective ink ejection nozzles arranged in a row extending along the width of the recording medium P and which is shown in section in FIG. 2.

To be more specific, the head chip comprises a Si substrate 100, heating resistors 102 formed on the substrate by sputtering, conductor electrodes 104 and 106 for energizing the heating resistors 102, and a drive portion 110 that is connected to the conductor electrodes 104 through via holes 108. Note that the heating resistor 102 combines with the conductor electrodes 104 and 106 to form a heater which is a device for pressurizing the ink. Also note that a protective film for preventing electrolytic corrosion, cavitation, etc. may be formed on the heater in order to prevent its direct contact with the ink.

The Si substrate 100 is overlaid with a partition layer 112 formed of a resin material such as polyimide. The partition layer 112 has partition walls 112*a* (see FIG. 3) provided in such a way that discrete ink channels 114 are formed in one-to-one correspondence to the heaters arranged in one direction (normal to the paper of FIG. 2). The discrete ink channels 114 are so adapted that they are connected to an ink supply channel 121 through a common ink passageway 115 and ink supply orifices 119 bored at spacings in the Si substrate 100. The ink supply channel 121 is provided in a mounting frame 120 and connected to the ink tank 56.

The ink ejection nozzles 116 are bored in a nozzle plate 118 which is part of those wall surfaces of the discrete ink channels 114 and are positioned generally right above the heating resistors 102 in FIG. 2; through these nozzles, ink droplets are ejected in a direction generally perpendicular to the surface of the nozzle plate 118. The ink ejection nozzles 116 are provided in positions that are opposite to the heating resistors 102. Note that the ink ejection nozzles 116 may be so adapted that ink droplets are ejected at a specified angle of inclination with the nozzle plate 118.

Figure 3:
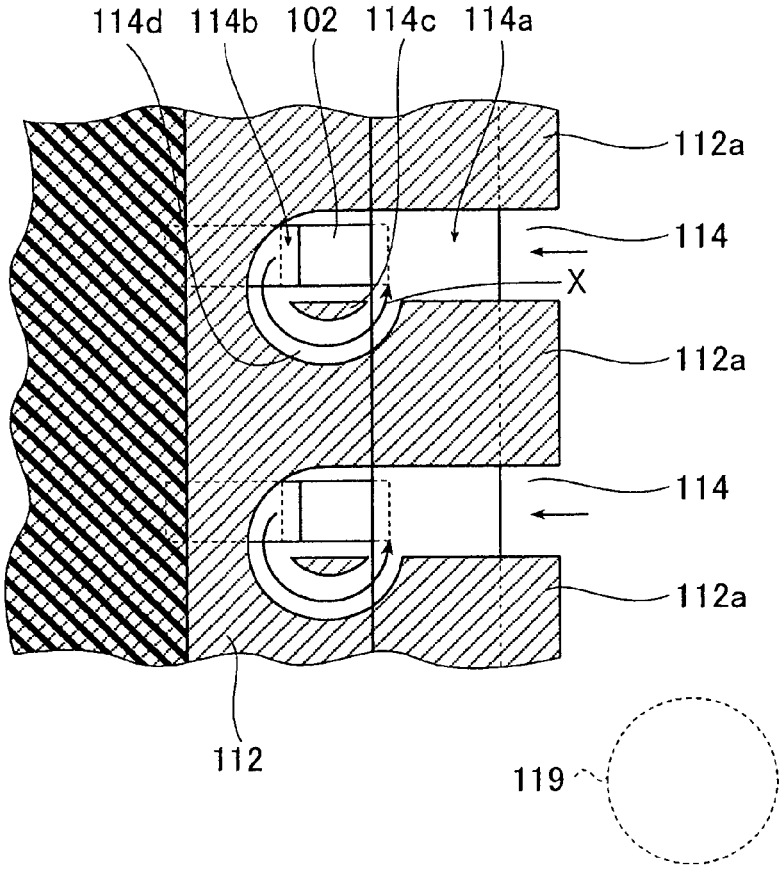
FIG. 3 is section A–A' of the inkjet head shown in FIG. 2.

FIG. 3 is section A–A' of the inkjet head 52 shown in FIG. 2.

The partition layer 112 has a plurality of partition walls 112*a* with a specified thickness that extend toward the common ink passageway 115 in such a way as to form the discrete ink channels 114 in one-to-one correspondence with the heating resistors 102. Adjacent discrete ink channels 114 are spaced apart by the partition walls 112*a*. Thus, the discrete ink channels 114 are defined by the partition layer 112 formed between the Si substrate 100 and the nozzle plate 118. The discrete ink channels 114 are so designed that each of them is closed at an end by the partition layer 112 and that ink is supplied through the common ink passageway 115 towards an ink pressurizing zone, or that part of wall surfaces of the discrete ink channel 114 which is halfway the ink flow and where the associated heating resistor 102 and ink ejection nozzle 116 are positioned. To state more specifically, each of the discrete ink channels 114 comprises a linear channel portion 114*a* and a spacious channel portion 114*b*; the linear channel portion 114*a* has a constant channel width in transverse direction and extends linearly from the upstream of ink supply (from the common ink passageway 115) whereas the spacious channel portion 114*b* is provided near the closed end of the discrete ink channel 114 (i.e. near the end which is downstream of ink supply) such that wall surfaces of the partition layer 112 form the side wall of a generally cylindrical shape, providing a larger channel width in transverse direction than the linear channel portion 114*a*.

Speaking further of the spacious channel portion 114*b*, that part of this portion which is near the position where it is connected to the linear channel portion 114*a* and which is in proximity to wall surfaces of the partition layer 112 serves as an ink pressurizing zone where the expansion force of a bubble evolved in the ink as the result of heating by the heating resistor 102 causes the ink to be pressurized toward the ink ejection nozzle 116. In other words, the ink pressurizing zone is offset from the center of the spacious channel portion 114*b*.

In the neighborhood of that part of the ink pressurizing zone of the spacious channel portion 114*b* which is remote from the area that is in proximity to wall surfaces of the partition layer 112, an island-like member 114*c* is provided to connect the Si substrate 100 to the nozzle plate 118 in such a way that it supports the space in the spacious channel portion 114*b* as it is surrounded with ink.

The area around the island-like member 114*c* serves as a path for the propagation of the ink pressurizing energy generated in the ink pressurizing zone. Stated specifically, the heating resistor 102 heats the ink locally and abruptly to form a bubble and the force of its expansion produces ink pressurizing energy, which travels from the ink pressurizing zone toward downstream of ink supply but is caused to propagate along a wall surface of the spacious channel portion 114*b* and go back toward more upstream of ink supply than the ink pressurizing zone (as indicated by arrow X in FIG. 3); this is an ink circulation path along which the ink pressurizing energy is made to return to the ink pressurizing zone and it is indicated by 114*d* in FIG. 3.

Stated more specifically, the pressurizing energy created in the ink pressurizing zone by pressurizing the ink propagates toward upstream of ink supply, downstream of ink supply and towards the ink ejection nozzle 116 opposite to the heating resistor 102. That part of the pressurizing energy which has propagated toward the ink ejection nozzle 116 serves as energy with which ink droplets are ejected whereas that part of the pressurizing energy which has propagated toward downstream of ink supply travels in the ink circulation path 114*d* and serves as energy for effecting ink refill in the ink pressurizing zone. Thus, the ink pressurizing energy that has propagated toward downstream of ink supply provides a driving force by which the ink positioned in the ink circulation path 114*d* is moved to the ink pressurizing zone.

The timing of returning the pressurizing energy through the ink circulation path 114*d* can be controlled to an optimum value by adjusting the layout and size of the island-like member 114*c*.

Such adjustment of the island-like member 114*c* can be made at a design stage by applying numerical fluid analysis and the like to perform simulated calculations of flow analysis on the discrete ink channels 114. Assume the following case as one example: the ink travels from the heating surface of the heating resistor 102 to the port of the ink ejection nozzle 116 over a distance of 25 μm; the ink ejection nozzle 116 has a diameter of 15 μm; an ink droplet having a volume of 4 p1 is caused to fly at 10 m/s; about 2.5 μs after the start of heating by the heating resistor 102, a bubble evolved in the ink is caused to communicate with the atmosphere at a speed of 10 m/s. In this case, about 3 μs after the start of heating, the pressurizing energy is preferably returned to a position which is upstream of ink supply and about 20 μm distant from the ink pressurizing zone, so that it is utilized as energy to effect ink refill. Assuming the ideal case where the width in transverse direction of the ink circulation path 114*d* and its length are both constant, it is preferred to adjust those values to 20 μm and make a resonator of the ink circulation path 114*d* which has a resonance frequency of about 80 kHz.

In the present invention, for the purpose of efficient ink refill considering the lapse of time from the evolution of a bubble to its expanding and eventually its extinction due to communication with the atmosphere, the time required for the pressurizing energy to propagate through the ink circulation path 114*d* to return to the ink pressurizing zone is preferably set at 3–40 μs after the start of heating.

The drive portion 110 energizes the heating resistor 102 at a predetermined drive frequency so that ink is pressurized and ink droplets are ejected. The characteristic of the resonator structure in the ink circulation path 114*d*, or the resonance frequency at which the ink pressure in the path 114*d* varies is preferably approximated by an integral multiple of the drive frequency of the drive portion 110. For example, the two frequencies suffice to satisfy a phase relationship that promotes ink refill on the intended timing and which may state that the ratio of resonance frequency to drive frequency is within the range of from (n−0.2) to (n+0.2) (n is a positive integer). If that ratio is approximated by an integral multiple, ink refill can always be performed timely enough in synchronism with the drive period of the heating resistor 102.

In the foregoing embodiment, the heater furnished with the heating resistor is used as an ink pressurizing element but this is not the sole case of the invention and a piezoelectric device or a diaphragm may be employed to apply mechanical vibration to the ink solution for pressurizing the ink.

The inkjet head 52 having the above-described construction works as follows: a pulse signal is applied from the drive portion 110 to the heater, causing heat generation from the heating resistor 102, whereupon a bubble is evolved and expands in that part of the ink solution within the discrete ink channel 114 which is positioned above the heating resistor 102; the expansion force of the bubble causes the ink solution to be pushed up toward the ink ejection nozzle 116 so that part of the ink is separated from the ink solution and ejected as a droplet.

At the same time, the pressurizing energy produced by pressurizing the ink propagates from the ink pressurizing zone toward downstream of ink supply. Such pressurizing energy moves past the ink circulation path 114*d* defined by the wall surfaces of the spacious channel portion 114*b* and the island-like member 114*c* such that it returns toward the ink pressurizing zone from the area which is more upstream of ink supply than the ink pressurizing zone. The returning pressurizing energy causes the ink in the ink circulation path 114*d* to be moved to the ink pressurizing zone to effect ink refill. Needless to say, ink refill under surface tension is also effected as in the prior art.

Thus, the ink pressurizing energy produced by the expansion force of the bubble evolved in the ink by heating with the heating resistor 102 in the ink pressurizing zone is not only utilized in the flight of ink droplets; it is also returned to the ink pressurizing zone via the ink circulation path 114*d* so that it is utilized as the energy for ink refill.

As a result, there is obviated the need of using the piezoelectric device, circulating pump and other elements that have been necessary in the prior art and one only need modify the configuration of discrete ink channels to realize an inkjet head that is less expensive and which yet can perform rapid and efficient ink refill.

Figure 4:
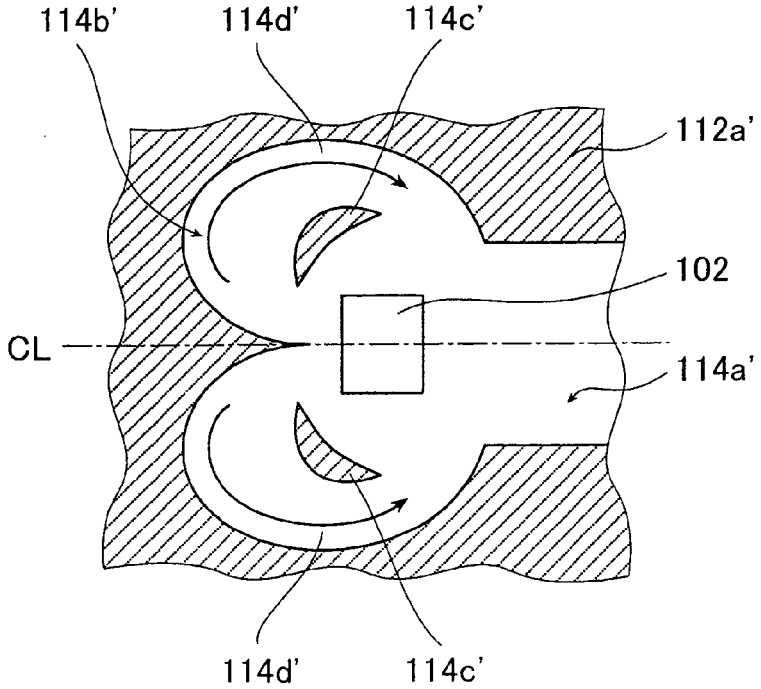
FIG. 4 is a cross section of another embodiment of the inkjet head of the invention.

Note that instead of the spacious channel portion 114*b* depicted in FIG. 3, the inkjet head of the invention may use a different design of spacious channel portion which is indicated by 114*b*' in FIG. 4. As shown, the heating resistor 102 is positioned on the center line CL through the spacious channel portion 114*b*' and two island-like members 114*c*' are provided in such a way that respective ink circulation paths 114*d*' are formed in symmetrical positions with respect to the center line CL.

FIG. 4 also shows a partition wall 112*a*' and a linear channel portion 114*a*' and these are structurally the same as the partition wall 112*a* and the linear channel portion 114*a* which are shown in FIG. 3.

The ink circulation path of the invention may be of any design as long as the ink pressurizing energy that has been produced as the result of pressurizing the ink and which travels toward downstream of ink supply is caused to propagate toward more upstream of ink supply than the ink pressurizing zone such that it is returned toward the ink pressurizing zone.

While the inkjet head and inkjet printer of the present invention have been described above in detail, it should be noted that the invention is by no means limited to the foregoing embodiments and various improvements and modifications can be made without departing from the scope and spirit of the invention. For example, the pressurizing element which is in the form of a heater furnished with a heating resistor may be replaced by a known type such as one that utilizes a piezoelectric device.

As described in detail on the foregoing pages, the inkjet head of the invention is characterized in that ink channels through which ink is supplied toward the ink pressurizing zones each having a pressurizing element and an ejection nozzle on wall surfaces are each furnished with an ink circulation path along which the ink pressurizing energy that has been produced in the ink pressurizing zone and which is traveling toward downstream of ink supply is allowed to propagate toward more upstream of ink supply than the ink pressurizing zone and, hence, rapid and efficient ink refill can be realized by the pressurizing energy that has returned via the circulation path. In consequence, the present invention provides an inkjet head and an inkjet printer that are less costly than the existing models.

What is claimed is:

1. An inkjet head for ejecting ink droplets, comprising:

a substrate;

pressurizing elements that are provided on said substrate, each pressurizing element pressurizing ink;

a nozzle plate that is spaced from said substrate and furnished with ejection nozzles, wherein said ink as pressurized by each pressurizing element is ejected as a droplet through each ejection nozzle;

ink channels provided in a gap between said substrate and said nozzle plate, each ink channel being closed at one end and permitting the ink to be supplied at another end and flow toward an ink pressurizing zone where said pressurizing element and said ejection nozzle are positioned on wall surfaces in said ink channel; and ink circulation paths, each being provided in said ink channel such that ink pressurizing energy which has been produced by pressurizing said ink with said pressurizing element and which is traveling from said ink pressurizing zone toward downstream of ink supply flow is allowed to propagate toward more upstream of said ink supply flow than said ink pressurizing zone, whereby said ink pressurizing energy is returned toward said ink pressurizing zone.

2. The inkjet head according to claim 1, wherein said nozzle plate is superposed on a partition layer which is provided on said substrate to serve as part of wall surfaces of said ink channel, said ink pressurizing zone is provided near said one end of said ink channel, and said ink circulation path is formed by an island-like member that is provided near said ink pressurizing zone as part of said partition layer and which is to be surrounded with the ink.

3. The inkjet head according to claim 1, wherein said pressurizing element pressurizes the ink by being driven on a timing determined by a specified drive frequency, and a resonance frequency at which ink pressure in said ink circulation path varies is so set that it is approximated by an integral multiple of said specified drive frequency.

4. An inkjet printer mounting an inkjet head, said inkjet head, comprising:

a substrate;

pressurizing elements that are provided on said substrate, each pressurizing element pressurizing ink;

a nozzle plate that is spaced from said substrate and furnished with ejection nozzles, wherein said ink as pressurized by each pressurizing element is ejected as a droplet through each ejection nozzle;

ink channels provided in a gap between said substrate and said nozzle plate, each ink channel being closed at one end and permitting the ink to be supplied at another end and flow toward an ink pressurizing zone where said pressurizing element and said ejection nozzle are positioned on wall surfaces in said ink channel; and ink circulation paths, each being provided in said ink channel such that ink pressurizing energy which has been produced by pressurizing said ink with said pressurizing element and which is traveling from said ink pressurizing zone toward downstream of ink supply flow is allowed to propagate toward more upstream of said ink supply flow than said ink pressurizing zone, whereby said ink pressurizing energy is returned toward said ink pressurizing zone.

5. The inkjet printer according to claim 4, wherein said nozzle plate is superposed on a partition layer which is provided on said substrate to serve as part of wall surfaces of said ink channel, said ink pressurizing zone is provided near said one end of said ink channel, and said ink circulation path is formed by an island-like member that is provided near said ink pressurizing zone as part of said partition layer and which is to be surrounded with the ink.

6. The inkjet printer according to claim 4, wherein said pressurizing element pressurizes the ink by being driven on a timing determined by a specified drive frequency, and a resonance frequency at which ink pressure in said ink circulation path varies is so set that it is approximated by an integral multiple of said specified drive frequency.

* * * * *